US010094052B1

(12) United States Patent
Tsai et al.

(10) Patent No.: US 10,094,052 B1
(45) Date of Patent: Oct. 9, 2018

(54) FIRE RETARDANT MATERIAL AND METHOD OF MAKING THE SAME

(75) Inventors: Jung-Huang (Jason) Tsai, Hsinchu (TW); Elizabeth Clagg, Claremore, OK (US); Mitchael C. Freeman, Norman, OK (US); Andrew M. Allen, Safety Harbor, FL (US); Paige Johnson, Collinsville, OK (US); William D. Townsend, Hendersonville, NC (US)

(73) Assignee: National Safety Apparel, Inc., Cleveland, OH (US)

( * ) Notice: Subject to any disclaimer, the term of this patent is extended or adjusted under 35 U.S.C. 154(b) by 317 days.

(21) Appl. No.: 12/868,809

(22) Filed: Aug. 26, 2010

Related U.S. Application Data

(60) Provisional application No. 61/237,085, filed on Aug. 26, 2009.

(51) Int. Cl.
*D03D 15/12* (2006.01)
*D02G 3/44* (2006.01)

(52) U.S. Cl.
CPC ..... *D02G 3/443* (2013.01); *D10B 2321/10* (2013.01)

(58) Field of Classification Search
CPC .. D02G 3/443; D10B 2321/10; Y10S 428/921
USPC ..... 442/136
See application file for complete search history.

(56) References Cited

U.S. PATENT DOCUMENTS

| | | | | |
|---|---|---|---|---|
| 4,837,076 | A | 6/1989 | McCullough, Jr. et al. | |
| 4,865,906 | A | 9/1989 | Smith, Jr. | |
| 4,900,613 | A * | 2/1990 | Green | 442/189 |
| 4,970,111 | A * | 11/1990 | Smith, Jr. | 442/334 |
| 5,506,043 | A | 4/1996 | Lilani | |
| 5,763,103 | A | 6/1998 | McCullough | |
| 6,287,686 | B1 | 9/2001 | Huang et al. | |
| 6,358,608 | B1 | 3/2002 | Hanyon et al. | |
| 6,627,122 | B1 * | 9/2003 | Tada et al. | 252/601 |
| 6,800,367 | B2 | 10/2004 | Hanyon et al. | |
| 7,087,300 | B2 | 8/2006 | Hanyon et al. | |
| 7,534,854 | B1 | 5/2009 | Paulauskas et al. | |
| 2004/0198125 | A1 * | 10/2004 | Mater et al. | 442/394 |
| 2006/0264136 | A1 * | 11/2006 | Chiantese | A41D 31/0027 442/304 |
| 2007/0231573 | A1 | 10/2007 | Thatcher | |
| 2008/0057807 | A1 | 3/2008 | Tutterow et al. | |
| 2008/0113175 | A1 * | 5/2008 | Ke | 428/221 |
| 2016/0053411 | A1 | 2/2016 | Atkinson | |

FOREIGN PATENT DOCUMENTS

| | | | | |
|---|---|---|---|---|
| CN | 1152342 | A | 6/1997 | |
| JP | 2001271231 | A * | 10/2001 | D01F 9/22 |
| WO | WO-01/092613 | A1 | 12/2001 | |

OTHER PUBLICATIONS

International Search Report dated Jul. 27, 2011 for application PCT/US10/53723, filed on Oct. 22, 2010 and published as WO 2011/050257 on Apr. 28, 2011 (Applicant—Invista Tech. S.A. R.L. // Inventor—Atkinson) (3 pages).

Written Opinion dated Jul. 27, 2011 for application PCT/US10/53723, filed on Oct. 22, 2010 and published as WO 2011/050257 on Apr. 28, 2011 (Applicant—Invista Tech. S.A. R.L. // Inventor—Atkinson) (4 pages).

International Preliminary Report on Patentability dated Apr. 24, 2012 for application PCT/US10/53723, filed on Oct. 22, 2010 and published as WO 2011/050257 on Apr. 28, 2011 (Applicant—Invista Tech. S.A. R.L. // Inventor—Atkinson) (5 pages).

Requirement for Restriction or Election dated Sep. 25, 2012 for U.S. Appl. No. 12/910,275, filed Oct. 22, 2010 and published as US-2011-0104466-A1 on May 5, 2011 (Inventor—Atkinson) (13 pages).

Response to Requirement for Restriction or Election filed on Jan. 26, 2013 for U.S. Appl. No. 12/910,275, filed Oct. 22, 2010 and published as US-2011-0104466-A1 on May 5, 2011 (Inventor—Atkinson) (2 pages).

Non-Final Office Action dated Apr. 8, 2013 for U.S. Appl. No. 12/910,275, filed Oct. 22, 2010 and published as US-2011-0104466-A1 on May 5, 2011 (Inventor—Atkinson) (9 pages).

Response to Non-Final Office Action filed on Apr. 8, 2013 for U.S. Appl. No. 12/910,275, filed Oct. 22, 2010 and published as US-2011-0104466-A1 on May 5, 2011 (Inventor—Atkinson) (9 pages).

Final Office Action dated Oct. 9, 2013 for U.S. Appl. No. 12/910,275, filed Oct. 22, 2010 and published as US-2011-0104466-A1 on May 5, 2011 (Inventor—Atkinson) (9 pages).

Response to Final Office Action filed on Feb. 10, 2014 for U.S. Appl. No. 12/910,275, filed Oct. 22, 2010 and published as US-2011-0104466-A1 on May 5, 2011 (Inventor—Atkinson) (10 pages).

Advisory Action dated Feb. 20, 2014 for U.S. Appl. No. 12/910,275, filed Oct. 22, 2010 and published as US-2011-0104466-A1 on May 5, 2011 (Inventor—Atkinson) (3 pages).

Non-Final Office Action dated Dec. 5, 2014 for U.S. Appl. No. 12/910,275, filed Oct. 22, 2010 and published as US-2011-0104466-A1 on May 5, 2011 (Inventor—Atkinson) (9 pages).

Response to Non-Final Office Action filed on Feb. 5, 2015 for U.S. Appl. No. 12/910,275, filed Oct. 22, 2010 and published as US-2011-0104466-A1 on May 5, 2011 (Inventor—Atkinson) (11 pages).

Non-Final Office Action dated Mar. 2, 2015 for U.S. Appl. No. 12/910,275, filed Oct. 22, 2010 and published as US-2011-0104466-A1 on May 5, 2011 (Inventor—Atkinson) (9 pages).

Requirement for Restriction/Election was dated Apr. 7, 2017 by the USPTO for U.S. Appl. No. 14/839,155, filed Aug. 28, 2015 and published as US 2016/0053411 A1 on Feb. 25, 2016 (Inventor—Zeb W. Atkinson) (13 pages).

Response to Requirement for Restriction/Election dated Sep. 5, 2017 to the USPTO for U.S. Appl. No. 14/839,155, filed Aug. 28, 2015 and published as US 2016/0053411 A1 on Feb. 25, 2016 (Inventor—Zeb W. Atkinson) (9 pages).

Final Rejection dated Oct. 27, 2017 by the USPTO for U.S. Appl. No. 14/839,155, filed Aug. 28, 2015 and published as US 2016/0053411 A1 on Feb. 25, 2016 (Inventor—Zeb W. Atkinson) (9 pages).

* cited by examiner

*Primary Examiner* — Vincent Tatesure
(74) *Attorney, Agent, or Firm* — Ballard Spahr LLP

(57) ABSTRACT

This invention is directed to a light weight fire resistant material. The material is constructed of a plurality of oxidized polyacrylonitrile (OPAN) fibers. The fire resistant material having a weight in the range of less than about 9.0 oz/yd$^2$, an Arc Thermal Performance Value of greater than about 8.0 and a Thermal Protection Performance of greater than about 13.0.

13 Claims, No Drawings

FIRE RETARDANT MATERIAL AND METHOD OF MAKING THE SAME

CROSS-REFERENCE TO RELATED APPLICATIONS

The present application is a conversion of U.S. Provisional Application having U.S. Ser. No. 61/237,085, filed Aug. 26, 2009 which claims the benefit under 35 U.S.C. 119(e). The entire disclosure of which is hereby expressly incorporated herein by reference.

STATEMENT REGARDING FEDERALLY SPONSORED RESEARCH OR DEVELOPMENT

Not Applicable.

BACKGROUND OF THE INVENTION

1. Field of the Invention

This invention relates to an abrasion and fire resistant material and/or a fire resistant fabric. More particularly, the present invention relates to a fire resistant fabric containing oxidized polyacrylonitrile that can be made into various types of lightweight fabric structures with increased density and fire resistance.

2. Description of the Related Art

There is a continuing need to improve protection against flame, heat and flash fire for pilots, firefighters, steelworkers, and the like. This is particularly critical for personnel who are frequently at close quarters when heat, flame and flash hazards occur. The primary line of protection is the fabric comprising the protective clothing worn by the individual. In addition to providing protection, it is important that this clothing also feel comfortable in order to increase the likelihood it will be worn at all times that the individual would be at risk.

The current lightweight fire resistant materials known in the art have deficiencies. For example, some known lightweight fire retardant materials can melt and cling to the skin during exposure to severe heat or flame as those used, for example, in military uniforms such as the BDU (battle dress uniform) which is made of 50% cotton and 50% nylon. Other fabrics, such as Nomex®, are plastic-based products which provide fire protection by combusting (oxidizing) in a low flame manner and leaving behind a brittle Char that has some heat protection capabilities. Although these products do not melt and stick, they will break apart under the slightest dress or movement, leaving the wearer naked to a flame. The yarn of previous lightweight fire resistant materials, including inherently fire resistant fibers, had to be spun in a thick fashion in order to have sufficient strength for weaving. Therefore, the only way to produce a lightweight fabric was to take these thick yarns and weave them loosely, which severely decreased the density, strength and fire resistant ability of the material.

Inherently fire resistant fibers are well-known to those skilled in the art. These fibers, known as matrix fibers, are useful because of their fire resistant qualities but, are not strong enough to form their own fabrics, tend to have a non-uniform composition, are not susceptible of being easily dyed, and, in general, are not alone suitable for production into piece goods from which finished products, like clothing, are formed. On the other hand, conventional natural and synthetic fibers (staple fibers) which are alone suitable for production into finished piece goods, are not inherently fire resistant.

Accordingly, there remains a need for a fire resistant material capable of having a desirable density (thread count), weight, and fire resistance.

SUMMARY OF THE INVENTION

The invention is directed to a lightweight fire resistant material. The material is constructed of a plurality of oxidized polyacrylonitrile (OPAN) fibers. The fire resistant material includes a weight in the range of less than about 9.0 oz/yd$^2$, an Arc Thermal Performance Value of greater than about 8.0 and a Thermal Protection Performance of greater than about 13.0.

In another embodiment of the present invention, a method of providing the lightweight fire resistant material is provided. The fire resistant material is constructed by providing a plurality of oxidized polyacrylonitrile fibers. Once the oxidized polyacrylonitrile fibers are provided, the oxidized polyacrylonitrile fibers are woven together wherein the fire resistant material has a weight in the range of less than about 9.0 oz/yd$^2$, an Arc Thermal Performance Value of greater than about 8.0 and a Thermal Protection Performance of greater than about 13.0.

DETAILED DESCRIPTION OF THE INVENTION

The present invention relates to a fire resistant material. The fire resistant material can be a yarn, a fabric made from the yarn, felt, any type of fibrous blend, and/or a combination thereof. In accordance with the present invention, the fire resistant material includes oxidized polyacrylonitrile (OPAN) fibers to provide high fire and heat resistance to the fire resistant material.

In addition to the OPAN, the fire resistant material can include other types of fibers to provide the fire resistant material with various characteristics. For example, additional fibers can be included to impart tensile strength, tear strength and abrasion resistance to the fire resistant material. The fibers of the fire resistant material can be woven, knitted, or otherwise assembled into appropriate fabrics to make a wide variety of fire and heat resistant articles of manufacture such as clothing, jump suits, gloves, socks, welding bibs, fire blankets, floor boards, padding, protective head gear, linings, undergarments, cargo holds, bedding, mattress insulation, drapes, insulating fire walls, and the like. It should be understood and appreciated that the OPAN fibers and the additional fibers can be blended in any manner known in the art for blending various different types of fibers.

The OPAN fibers are included in the fire resistant material in any amount such that the desired fire resistance is provided to the fire resistant material. The OPAN fibers can be included in the present invention in a range of from about 1% to 100% by weight of the fire resistant material. In one embodiment of the present invention, the OPAN fibers are provided in a range of from about 25% to about 99.9% by weight of the fire resistant material. In another embodiment of the present invention, the OPAN fibers are provided in a range of from about 25% to about 85% by weight of the fire resistant material. In a further embodiment of the present invention, the OPAN fibers are provided in a range of from about 30% to about 75% by weight of the fire resistant material.

The OPAN fibers can be any length such that the desired fire resistance is provided to the fire resistant material. Longer OPAN fibers provides the fire resistant material with higher tensile strength. In one embodiment of the present invention, the OPAN fibers can be provided in lengths in a range of from about 50 mm to about 100 mm. In another embodiment of the present invention, the OPAN fibers can be provided in lengths in a range of from about 70 mm to about 80 mm. In yet another embodiment of the present invention, the OPAN fibers can be provided in lengths in a range of from about 73 mm to about 76 mm.

In a further embodiment of the present invention, the OPAN fibers can have any linear mass density or specific gravity such that the fire resistant material has the desired physical characteristics. In one embodiment of the present invention, the linear mass density of the OPAN fibers is in a range of from about 1.5 denier to about 3.0 denier. In another embodiment of the present invention, the linear mass density of the OPAN fibers is about 2.0 denier. In a further embodiment of the present invention, the specific gravity of the OPAN fibers is in a range of from about 1.2 to about 1.6. In yet another embodiment of the present invention, the specific gravity of the OPAN fibers is in a range of from about 1.35 to about 1.47.

Examples of additional fibers that can be provided in the fire resistant material includes, but is not limited to, polyvinyl halide, polybenzimidazole (PBI), polyphenylene-2,6-benzobisoxazole (PBO) para-aramid, meta-aramid, modacrylic, wool, fire resistant wool, fire resistant nylon, cotton, melamine, fire resistant polyester, fire resistant rayon, and combinations thereof.

Para-aramid fiber can be added to the fire resistant material to add strength to the fire resistant material. The para-aramid can be sized so as to provide optimal strength to the fire resistant material. In one embodiment of the present invention, the fire resistant material can be provided with para-aramid fibers having a length in a range of about 38 mm to about 76 mm. In another embodiment of the present invention, the fire resistant material can be provided with para-aramid fibers having a length of about 50 mm.

The additional fibers can be added to the fire resistant material in any amount such that desired characteristics associated with the specific additional fibers are imparted on the fire resistant material to provide the fire resistant material with the desired physical properties. In one embodiment, the additional fibers can be provided in an amount of less than about 75% by weight of the fire resistant material. In another embodiment of the present invention, the additional fibers can be provided in an amount of from about 25% to about 65% by weight of the fire resistant material.

The fire resistant material of the present invention can be constructed such that the material has warp lines (or long lines in the material) and weft lines (or short lines in the material). In another embodiment of the present invention, the fire resistant material is provided with stainless steel fibers to retard the static buildup in the fire resistant material. In a further embodiment of the present invention, the stainless steel fibers are only provided in the weft lines of the fire resistant material.

The stainless steel fibers can be included in the fire resistant materials in any amount such that the desired static resistance or desired static buildup retardance is achieved. In one embodiment of the present invention, the stainless steel fibers can be included in the fire resistant material in an amount in a range of less than about 2.0%.

In another embodiment of the present invention, the fire resistant material is constructed of longer fibers. These longer fibers allow for the creation of thinner yarns. The thinner yarns created from the longer fibers have a yarn count of Nm 1/48. The thinner and stronger yarn in the fire resistant material provides the fire resistant material with a thinner, stronger and more dense fabric while still maintaining a lighter weight. Further, the fire resistant material constructed with longer fibers has a higher thread count than fire resistant material made with a yarn count of Nm 1/36, for example. In another embodiment of the present invention, the thinner yarns have a yarn count of Nm 2/48. Similarly, the yarn count of Nm 2/48 has a higher thread count than material made with a yarn count of Nm 2/36.

The fire resistant material constructed in accordance with the present invention can be fabricated such that the material can have a specific weight. In one embodiment of the present invention, the fire resistant material is provided with a weight in a range of less than about 9.0 oz/yd$^2$. In another embodiment of the present invention, the fire resistant material is provided with a weight in a range of less than about 7.0 oz/yd$^2$. The fire resistant material of the present invention, while being less than about 7.0 oz/yd$^2$, will have an Arc Thermal Performance Value (ATPV) of greater than about 8.0 and a Thermal Protection Performance (TPP) value of greater than about 13.

In another embodiment of the present invention, chitosan can be applied on/to the fire resistant material to greatly increase the fire resistant capability of the fire resistant material. The amount of chitosan that can be used can be any amount such that the fire resistant material has the desired fire resistance. In one embodiment, the amount of chitosan used is in a range of from about 0.1% to about 10.0% by weight of the fire resistant material.

The chitosan can be bonded to the fire resistant material by mixing the chitosan in a solvent and then applying the resultant solution to the fire resistant material. Examples of solvents include, but are not limited to, acetic acid and citric acid. It should be understood and appreciated that the solvent can by any material known in the art for being able to properly apply chitosan to the fire resistant material.

In a test conducted, by GSL, a non-chitosan treated fire resistant material, about 8 oz/sq yard of fire resistant material was subjected to a propane torch rated at 1800° F.-2000° F. from a distance of about 12 inches. After being continuously subjected to the flame for a period of about 7 minutes, a small hole was ablated through the fabric. As a comparison, the same test was run against an identical piece of fire resistant material, with the exception being a treatment of chitosan was applied to the fabric and allowed to dry before onset of the flame test. The result was an additional burn-through protection time of about 7 minutes. This chitosan treatment doubled the already significant burn through protection of the fire resistant material.

Combined Heat and Stress Fabric Test

Recognizing the inadequacies of current certification tests, an enhanced fabric fire test was designed. This test adds a simulation of real world elements by placing the tested fabric under stress. The stress is designed to simulate the same fabric pressures resulting from normal bodily movements, such as bending, twisting and stretching. The material of the present invention outperforms other fabrics by an order of magnitude.

Such movements would normally be experienced, for example, when entering or exiting a vehicle compartment or from downward pressure exerted by equipment attached to an individuals clothing (e.g. a soldier's uniform). Running from one location to the next would also place stress on the fabric. Fire resistant fabrics would probably experience more severe stress when an injured individual is pulled from a burning vehicle, especially if the rescuer were to use the fabric as a handle to pull a person to safety.

This test apparatus was modeled after ASTM D 6413, Flame Resistance of Textiles (Vertical Test) (1999). This test incorporated a test stand to support a strip of fabric. The test apparatus consisted of a stationary stand with a top and bottom set of metal plates held together by a three wing nuts. The top plates were stationary, with the bottom plates having the ability to move freely in a vertical motion on the stand. One inch of fabric was inserted between the top two metal plates. When the fabric was level the wing nuts were tightened thereby securing the fabric from slipping. The bottom plates were then brought up to meet the bottom of the fabric so that an inch of fabric could be inserted and secured. After the fabric was secured, a 6 in. by 11.5 in. fabric strip was left for burning/testing. The bottom plate exerted 3.15 pounds of force to the fabric.

Next, a flame heat source was aligned to focus 2.2 cal/cm$^2$-sec on the center of the fabric strip. Time was recorded from when the torch was started until the fabric strip broke apart as a result of the heat and stress exerted on the test sample. The results for various fire retardant fabrics are shown in Table 1. It should be understood and appreciated that Spentex® is the commercial name of the fire resistant material constructed in accordance with the present invention.

TABLE 1

Seconds before Heat/Stress Break Open.

| Fabric Brand | Pull Force (pounds) | Stress Applied to Fabric (psi) | Average Time Fabric Burned Before Breaking (seconds) |
|---|---|---|---|
| Nomex ® IIIA 4.5 oz. | 3.15 | 32.8 | 0.65 |
| Blended FR Cotton (88/12) 7 oz. | 3.15 | 32.8 | 1.285 |
| Spentex ® 6.2 oz. | 3.15 | 32.8 | 36.195 |

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A lightweight fire resistant apparel material consisting of a plurality of oxidized polyacrylonitrile, modacrylic, fire resistant rayon and para-aramid fibers, and optional chitosan, wherein;

the oxidized polyacrylonitrile fibers are present in the fire resistant apparel material up to 25% by weight, the modacrylic and fire resistant rayon have a combined percentage of 65% to 75% by weight, wherein the oxidized polyacrylonitrile, modacrylic, fire resistant rayon and para-aramid fibers are staple fibers;

wherein a ratio of ATPV to weight being no less than 8/7; and wherein the fire resistant apparel material is in the form of a yarn.

2. The material of claim 1, wherein oxidized polyacrylonitrile fibers of the fiber resistant material are provided in a length in a range of from about 73 mm to about 76 mm.

3. The material of claim 1, wherein the weight of the fire resistant apparel material is in a range of less than about 7.0 oz/yd$^2$.

4. The material of claim 1, wherein the specific gravity of the oxidized polyacrylonitrile fibers is in a range of from about 1.35 to about 1.47.

5. The material of claim 1, wherein the linear mass density of the oxidized polyacrylonitrile fibers is in a range of from about 1.2 denier to about 3.0 denier.

6. The material of claim 1, wherein said chitosan is present in an amount sufficient, when applied to the plurality of oxidized polyacrylonitrile fibers, to increase the fire resistance of the fire resistant apparel material.

7. The material of claim 6, wherein the amount of chitosan applied is in a range of from about 0.1% to about 10.0% by weight of the fire resistant apparel material.

8. The material of claim 1, wherein the fire resistant apparel material has a Thermal Protection Performance of greater than about 13.0.

9. The material of claim 1, wherein the fire resistant apparel material has a yarn count in a range of 36/"n" Nm to 48/"n" Nm, where n=1 or 2.

10. A fire resistant apparel material consisting of:

20% by weight oxidized polyacrylonitrile fibers, modacrylic and fire resistant rayon fibers with a combined percentage of 65% to 75% by weight, and p-aramid fibers, wherein the oxidized polyacrylonitrile, modacrylic, fire resistant rayon and p-aramid fibers are staple fibers;

wherein a ratio of ATPV to weight being no less than 8/7; and wherein the fire resistant apparel material is in the form of a yarn.

11. The material of claim 1, wherein the para-aramid fibers have a fiber length in a range of from about 38 mm to about 76 mm.

12. The material of claim 1, wherein the fire resistant apparel material when woven or knitted together has a weight in the range of less than about 9.0 oz/yd$^2$ and an Arc Thermal Performance Value (ATPV) of greater than about 8.0.

13. The material of claim 10, wherein the fire resistant apparel material when woven or knitted together has a weight in the range of less than about 9.0 oz/yd$^2$ and an Arc Thermal Performance Value (ATPV) of greater than about 8.0.

* * * * *